US012287115B1

(12) United States Patent
Ismail et al.

(10) Patent No.: US 12,287,115 B1
(45) Date of Patent: Apr. 29, 2025

(54) SMART VENT/DUCT COVER FOR CONTROLLING AND COOLING TEMPERATURES INDIVIDUAL ROOMS

(71) Applicant: KING FAISAL UNIVERSITY, Al-Ahsa (SA)

(72) Inventors: Abdelrahim Fathy Ismail, Al-Ahsa (SA); Alhosein Hamada Abdelazeem, Al-Ahsa (SA); Ali Khalifa Atwa Abdullatif, Al Hofu (SA); Hussain Matuq Al-Hadlaq, Al-Ahsa (SA); Fadel Mohammad Alamer, Al-Ahsa (SA); Abdrabalameer Salman Alboali, Al-Ahsa (SA); Ibrahim Jawad Alabdullah, Al-Ahsa (SA); Salah Almohameed, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/795,693

(22) Filed: Aug. 6, 2024

Related U.S. Application Data

(62) Division of application No. 18/429,048, filed on Jan. 31, 2024, now Pat. No. 12,098,861.

(51) Int. Cl.
*F24F 13/12* (2006.01)

(52) U.S. Cl.
CPC ..... *F24F 13/12* (2013.01)

(58) Field of Classification Search
CPC .. F24F 13/10; F24F 13/12; B60H 2001/00728
See application file for complete search history.

(56) References Cited

U.S. PATENT DOCUMENTS

| | | | | |
|---|---|---|---|---|
| 4,567,816 | A | 2/1986 | Kolt | |
| 5,105,730 | A * | 4/1992 | Smith | B60H 1/00692 454/145 |
| 5,243,830 | A * | 9/1993 | Ito | B60H 1/00692 62/344 |
| 11,255,551 | B2 | 2/2022 | Kim et al. | |
| 11,434,641 | B2 | 9/2022 | Thompson et al. | |
| 2014/0030976 | A1 | 1/2014 | Spalding | |

FOREIGN PATENT DOCUMENTS

| | | | |
|---|---|---|---|
| CN | 219955783 | U * | 11/2023 |
| DE | 3622830 | A1 | 1/1988 |
| JP | 2010133646 | A | 6/2010 |
| JP | 5209956 | B2 | 6/2013 |
| WO | 2007055671 | A1 | 5/2007 |

* cited by examiner

*Primary Examiner* — Allen R. B. Schult
(74) *Attorney, Agent, or Firm* — Nath, Goldberg & Meyer; Joshua B. Goldberg

(57) ABSTRACT

A smart air duct/vent cover plate for air conditioning and ventilation can be implemented either as a nested three-cylinder device which or as a cover frame with a flexible layer perforated with through holes. Either device provides selectivity in terms of the amount of airflow provided to an interior ambient air space. The functionality of both devices can be controlled by a wireless handheld remote control.

4 Claims, 5 Drawing Sheets

SMART VENT/DUCT COVER FOR CONTROLLING AND COOLING TEMPERATURES INDIVIDUAL ROOMS

CROSS-REFERENCE TO RELATED APPLICATION

This application is a divisional of U.S. patent application Ser. No. 18/429,048, filed on Jan. 31, 2024, the entire contents of which are incorporated herein by reference.

TECHNICAL FIELD

The invention belongs to the technical field of residential room air conditioning and ventilation products, and particularly relates to a smart vent/air duct cover for air conditioning and ventilation.

BACKGROUND

Air conditioning and ventilation allow an outside source of air of a desired temperature to enter into a room of a building, either a residential or non-residential room, and mix with the ambient air of the room in order to change the temperature of the ambient air of the room to a cooler temperature or a warmer temperature in order to provide comfort to the occupants of the room. In some instances the grill covers of the duct offer no selectivity in how much air provided by the air conditioning or ventilation is introduced into the ambient air of the room currently occupied.

Furthermore, sometimes the location of the duct/vent covers for air conditioning and/or ventilation ducts are overhead in the ceilings or on the floor or lower portions of the walls where furniture placement precludes easy accessibility to these openings.

Accordingly, a remote control option for opening and closing the duct/vent covers exists so that a desired airflow of air-conditioned or ventilated air can be introduced into the ambient air of an interior room by occupants in order to accommodate a varying degree of comfort levels.

However, there remains a need for smart devices that can adjust the airflow as needed to maintain a desired temperature.

SUMMARY

A first embodiment of the present subject matter is a device for attaching or affixing an air duct/vent opening into an interior room of a residential building solving the technical problem of a lack of graduated control of airflow into the interior space. The design of the first embodiment is a nested three cylinder-based device that, when pushed up by manual force, can slide outwards, thereby providing a space between horizontally extending strip like vanes into the duct/vent opening to allow airflow into the ambient air of the interior room. When the nested three-cylinder device is pressed together by a manual force, the nested three cylinders can slide inward and into a more compact arrangement, thereby eliminating the space between the horizontally extending strip like vanes in the duct/vent opening to restrict airflow into the interior room.

A modification of the first embodiment includes providing a motor for driving the sliding action of the nested three cylinder-based device completely open, partially open, or completely closed. The motor can be controlled by a handheld remote controller which controls the functionality of the motor of the device using an infrared signal.

A second embodiment provides an air duct/vent cover screen for attachment or affixing to a duct/vent opening into an interior room of a residential building and solves the technical problem of a lack of graduated control of airflow into the interior space.

In order to solve the technical problems, the present embodiment adopts a technical scheme that can include an air duct cover plate comprising: a cover plate frame formed with an open area; a flexible assembly arranged on the cover plate frame and comprising a flexible layer, the flexible layer covering the open area and being used for forming an air outlet wall surface, the flexible layer comprising two first rotating shafts which are oppositely arranged, the two first rotating shafts being respectively and rotatably arranged on the cover plate frame, and two ends of the flexible layer being respectively and rotatably arranged on the first rotating shafts.

According to the second embodiment, the air outlet wall surface formed by the flexible layer can be distributed with air supply holes.

According to the second embodiment, a main air supply port can be formed at one side of the cover plate frame, and the aperture of the air supply hole can be gradually increased and/or the number of the air supply holes can gradually increase in a direction away from the main air supply port.

According to the second embodiment, the flexible layer can include at least one of a fabric, nonwoven fabric, or a plastic sheet.

A modification of the second embodiment can include providing a motor for driving the rotation action of one of the rotation shafts such that the flexible layer is completely deployed, partially deployed, or not deployed. The motor can be controlled by a handheld remote controller which can control the functionality of the motor of the device using an infrared signal.

BRIEF DESCRIPTION OF THE DRAWINGS

For a clearer description of the technical solutions of the embodiments of the present utility model, the drawings that are needed in the description of the embodiments will be briefly introduced below, it being obvious that the drawings in the description below are only some embodiments of the present subject matter, and that other drawings can be obtained according to these drawings without undue effort for a person skilled in the art, wherein.

DETAILED DESCRIPTION

Figure 1:
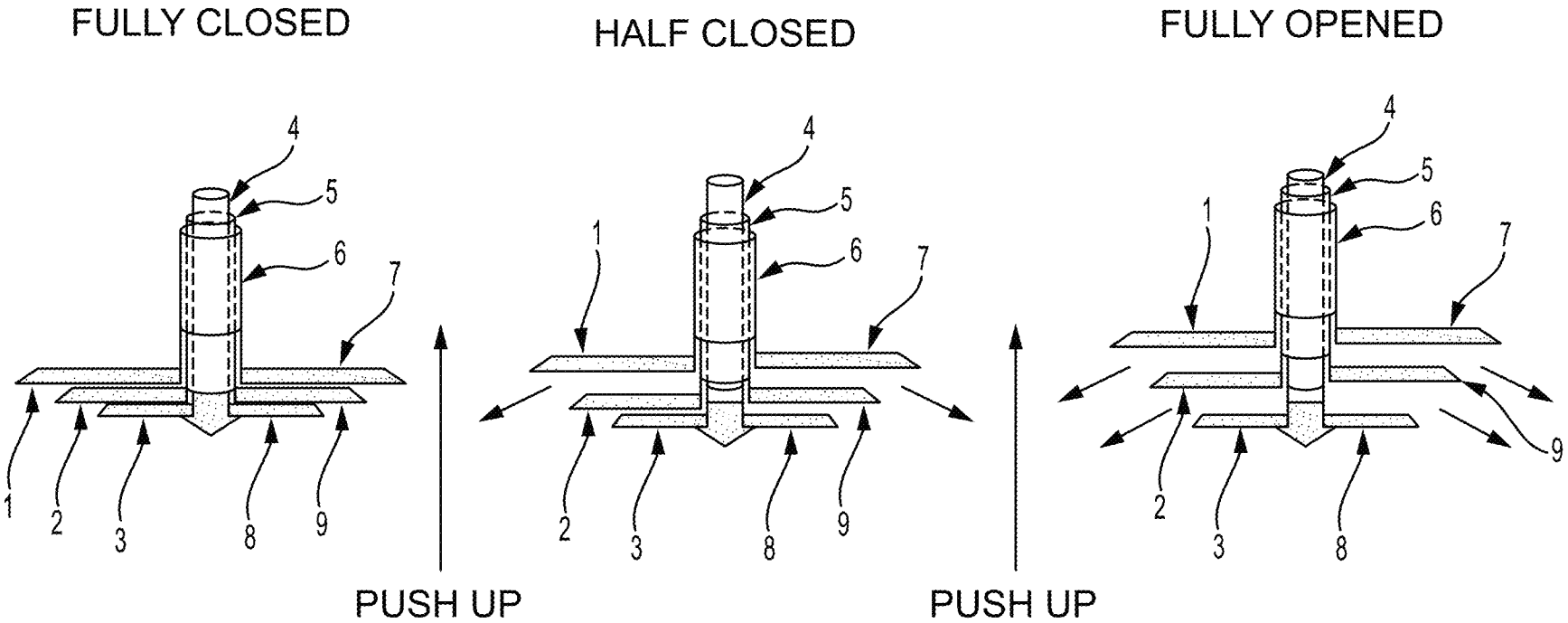
FIG. 1 is a schematic view of the overall structure of the air duct/vent device according to a first embodiment which shows the nested three-cylinder structure of the device when fully closed, half closed, and fully open.

In order that the above objects, features and advantages of the present subject matter will be readily understood, a more particular description of the present subject matter will be rendered by reference to the appended drawings. It is to be understood that the specific embodiments described herein are for purposes of illustration only and are not intended to limit the scope of the present subject matter. It should be further noted that, for convenience of description, only some, but not all of the structures related to the present subject matter are shown in the drawings. All other embodiments, which can be made by those skilled in the art based on the embodiments of the present subject matter without making any inventive effort, are intended to be within the scope herein.

Reference herein to "an embodiment" means that a particular feature, structure, or characteristic described in connection with the embodiment may be included in at least one embodiment of the present subject matter. The appearances of such phrases in various places in the specification are not necessarily all referring to the same embodiment, nor are separate or alternative embodiments mutually exclusive of other embodiments. Those of skill in the art will explicitly and implicitly appreciate that the embodiments described herein may be combined with other embodiments.

In the description of the present subject matter, the terms "first," "second," and the like are used for descriptive purposes only and are not to be construed as indicating or implying relative importance or implicitly indicating the number of technical features indicated. Thus, a feature defining "a first" or "a second" may explicitly or implicitly include one or more of the described features. In the description of the present subject matter, the meaning of "a plurality" is two or more, unless explicitly defined otherwise.

In this specification, unless explicitly stated and limited otherwise, the "upper" or "lower" of a first feature relative to a second feature may include the first and second features being in direct contact, or may include the first and second features not being in direct contact but being in contact with each other through another feature therebetween.

Moreover, a first feature being "above," "over" and "on" a second feature includes the first feature being directly above and obliquely above the second feature, or simply indicating that the first feature is higher in level than the second feature. The first feature being "under", "below" and "beneath" the second feature includes the first feature being directly under and obliquely below the second feature, or simply means that the first feature is less level than the second feature.

Figure 2:
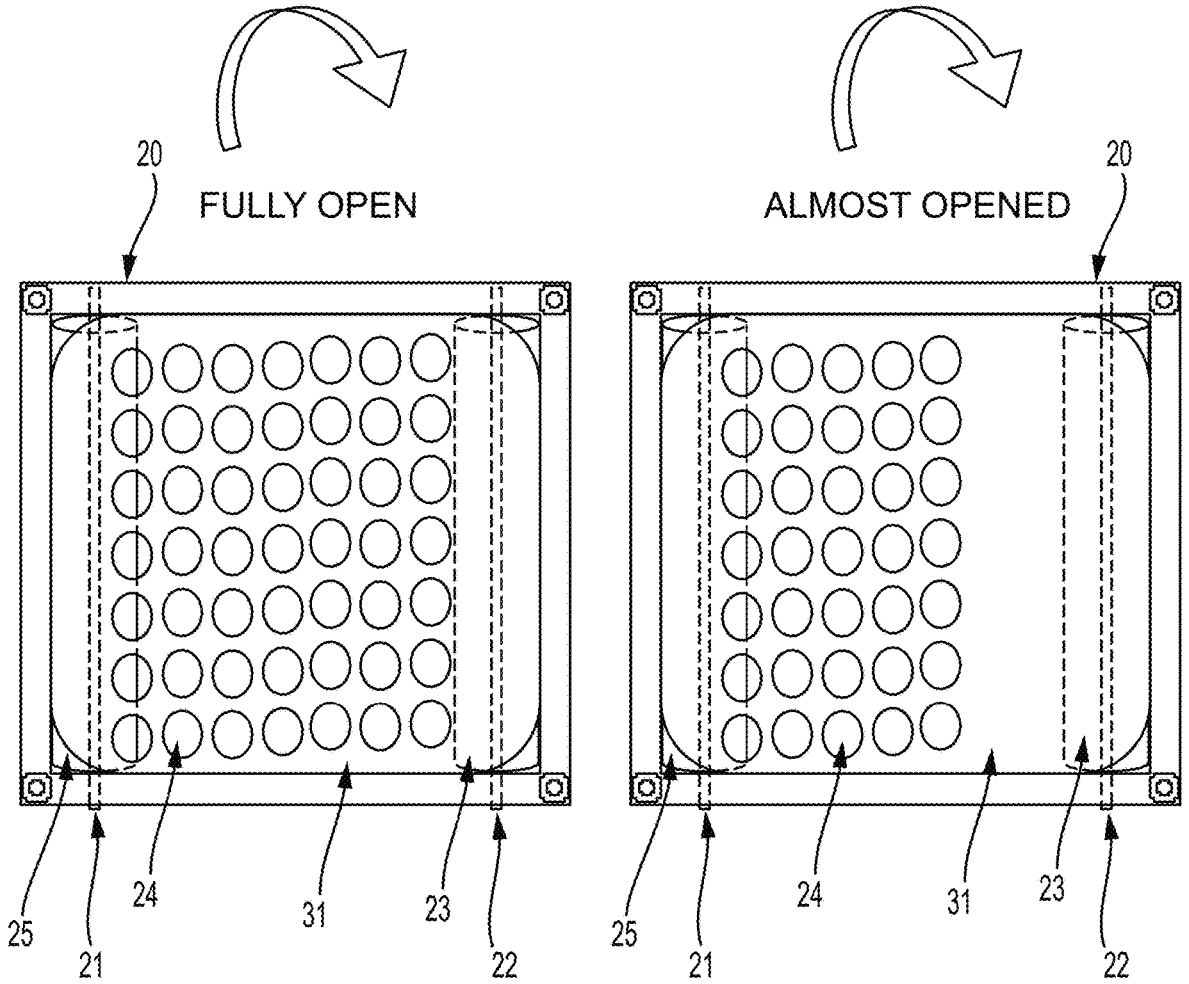
FIG. 2 is a schematic view of the overall structure of the second embodiment of the air duct/vent cover which shows the cover frame and the flexible layer fully opened, and almost fully opened.

Referring to FIGS. 1 and 2, FIG. 1 is a schematic diagram illustrating an overall structure of an air duct/vent cover according to a first embodiment; FIG. 2 is a schematic diagram of a duct/vent cover according to a second embodiment.

FIG. 1 depicts a first embodiment the duct/vent cover device for attachment or affixing to air duct/vent opening into an interior room of a residential building. The design of the first embodiment is a nested three cylinder-based device that, when pushed up by a manual force, slides outwards and thereby provides a space between horizontally extending strip like vanes into the duct/vent opening to allow airflow into the ambient air of the interior room. As can be seen in FIG. 1, the three nested cylinders are an innermost cylinder (4), an intermediate cylinder (5), and an outermost cylinder (6). FIG. 1 shows that the when fully closed, the innermost (4), intermediate (5), and outermost (6) cylinders are in a compact form. At the same end of each cylinder is a pair of horizontally extending strip like vanes that are situated perpendicular to each cylinder. The innermost cylinder (4) has a pair of horizontally extending strip like vanes (1, 7) at an end of the innermost cylinder (4). Respectively, the intermediate cylinder (5) has a pair of horizontally extending strip like vanes (2, 9) at the same end of the intermediate cylinder (5). Lastly, the outermost cylinder has its own pair of horizontally extending strip like vanes (3, 8) at the same end of outermost cylinder (6).

In use, manual force is applied to the outermost cylinder of the device to push it upward, thereby providing a first gap between the horizontally extending strip like vanes (1, 7) of the outermost cylinder (6) and the horizontally extending strip like vanes (2, 9) of the intermediate cylinder (5) as shown in the 'half closed' configuration of the nested three cylinder device (4, 5, 6) in FIG. 1. If more airflow is desired, then additional manual force is applied to the intermediate cylinder (5) to push it upward as well, to thereby provide a second gap between the horizontally extending strip like vanes (2, 9) of the intermediate cylinder (5) and the horizontally extending strip like vanes (3, 8) of the innermost cylinder (4). The air flows into the room through the first gap and the second gap in the full opened configuration and through only the first gap in the 'half closed' configuration of the nested three cylinder device (4, 5, 6). When no airflow is desired, the nested three cylinder device (4, 5, 6). is pressed together by a manual force, the nested three cylinders (4, 5, 6) slide inward and into a more compact arrangement, thereby eliminating the space between the horizontally extending strip like vanes in the duct/vent opening to restrict airflow into the interior room.

Additionally, the array of the three pairs of horizontally extending strip like vanes is dimensioned such that the length of the first pair of horizontally extending strip like vanes (1, 7), where the "length" is defined as the distance between the free end of a horizontally extending strip like first vane (1) and the free end of a horizontally extending strip like second vane (7) of this first pair, is greater than the length of the second pair of horizontally extending strip like vanes (2, 9) where the "length" is defined as the distance between the free end of a horizontally extending strip like first vane (2) and the free end of a horizontally extending strip like second vane (9) of this second pair. Likewise, the length of the second pair of horizontally extending strip like vanes (2, 9), where the "length" is defined as the distance between the free end of a horizontally extending strip like first vane (2) and the free end of a horizontally extending strip like second vane (8) of this second pair, is greater than the length the third pair of horizontally extending strip like vanes (3, 8), where the "length" is defined as the distance between the free end of a horizontally extending strip like first vane (3) and the free end of a horizontally extending strip like second vane (8) of this third pair. The nested three-cylinder device (4, 5, 6) is further designed such that the length of innermost cylinder (4) is greater than the length of the intermediate cylinder (5), and such that the length of the outermost cylinder (6) is greater than the length of the intermediate cylinder (5) as can be clearly seen in the 'fully opened' configuration of the nested three cylinder device (4, 5, 6) in FIG. 1.

Figure 4:
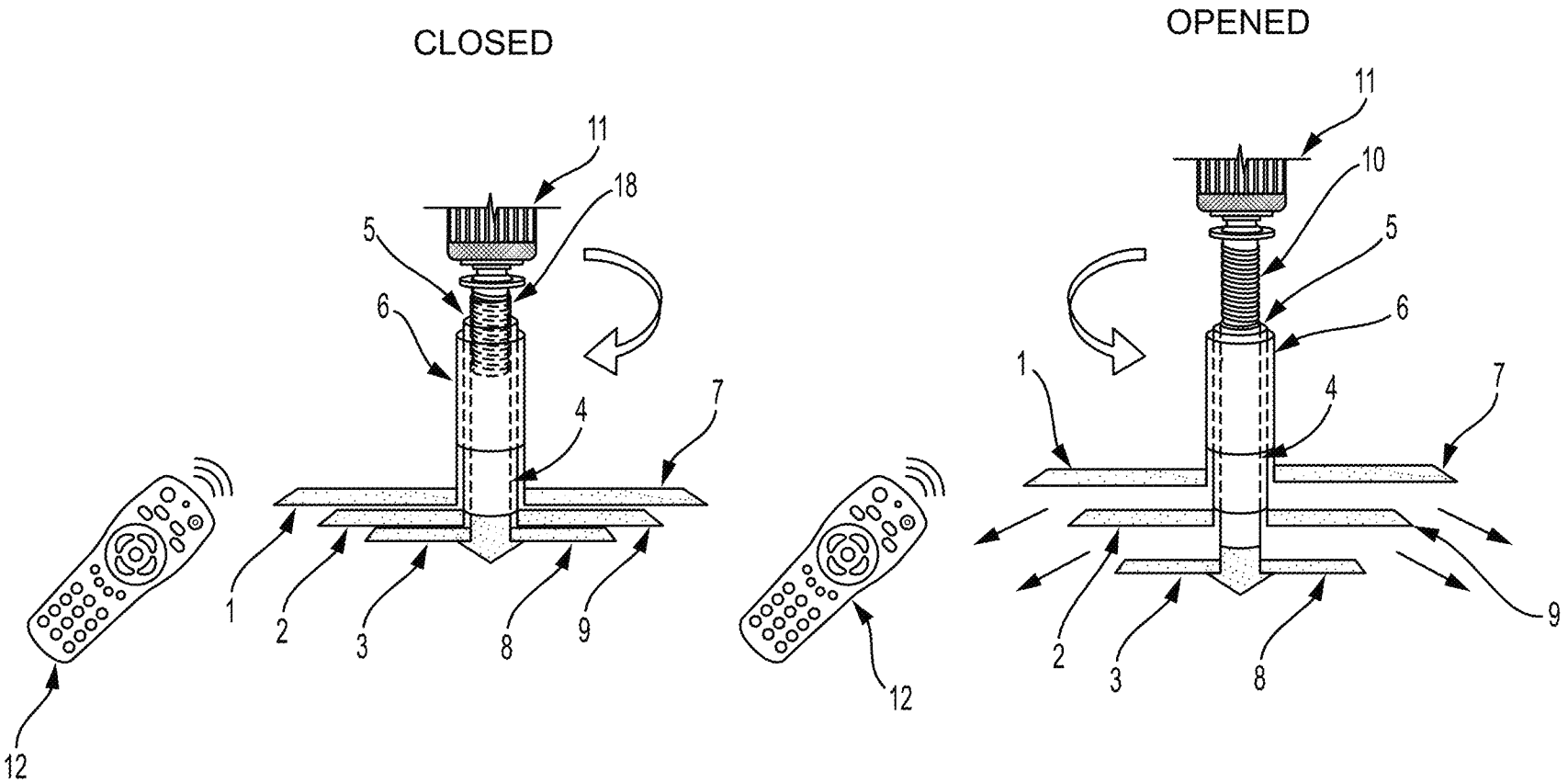
FIG. 4 is a schematic view of the overall structure of the air duct/vent device according to the first embodiment which shows the nested three-cylinder structure of the device when fully closed, half closed, and fully open and the modification of a remote controlled motor in cooperation with the nested three-cylinder structure.

FIG. 4 shows a modification of the first embodiment that includes having a motor (11) for driving a threaded screw (10) and, thereby, the sliding action of the nested three cylinder-based device (4, 5, 6) into 'fully open', 'half closed, or 'fully closed' configurations of FIG. 1. The motor (11) is controlled by a handheld remote controller (12) which controls the functionality of the motor (11) of the device using an infrared signal that is transmitted from the handheld controller to the motor of the nested three-cylinder device (4, 5, 6). The threaded screw seats inside the interior of the innermost cylinder (4) such that it can provide movement of the innermost cylinder with respect to the other cylinders. The commands issued by handheld remote controller (12) can close the nested three-cylinder device (4, 5, 6) by providing a command to drive the motor to rotate the threaded screw (10) in a clockwise fashion to close eliminate the first and second gaps of the respective pairs of horizontally extending strip like vanes (1, 7), (2,9), and (3,8).

In the alternative, the commands issued by handheld remote controller (12) can open the three-cylinder drive by providing a command to drive the motor (11) to rotate the threaded screw (10) in a counterclockwise fashion to open up or provide first and second gaps of the respective pairs of horizontally extending strip like vanes (1, 7), (2,9), and (3,8). The handheld remote can also provide the opening and closing commands for the nested three-cylinder drive (4, 5, 6) based upon a desired and pre-selected temperature which is measured by the handheld remote. The use of the handheld remote control can obviate the need for providing manual force to the nested three-cylinder (4, 5, 6) device such that the device can now be attached to duct/vent opening that may not be readily accessible by the occupants of the room (i.e., the ceiling or behind furniture).

The nested three-cylinder device can be made from plastic, resins, fiberglass, aluminum, other light metals, and/or other suitable materials known in the art and deemed suitable for the implementation of the device.

Figure 3:
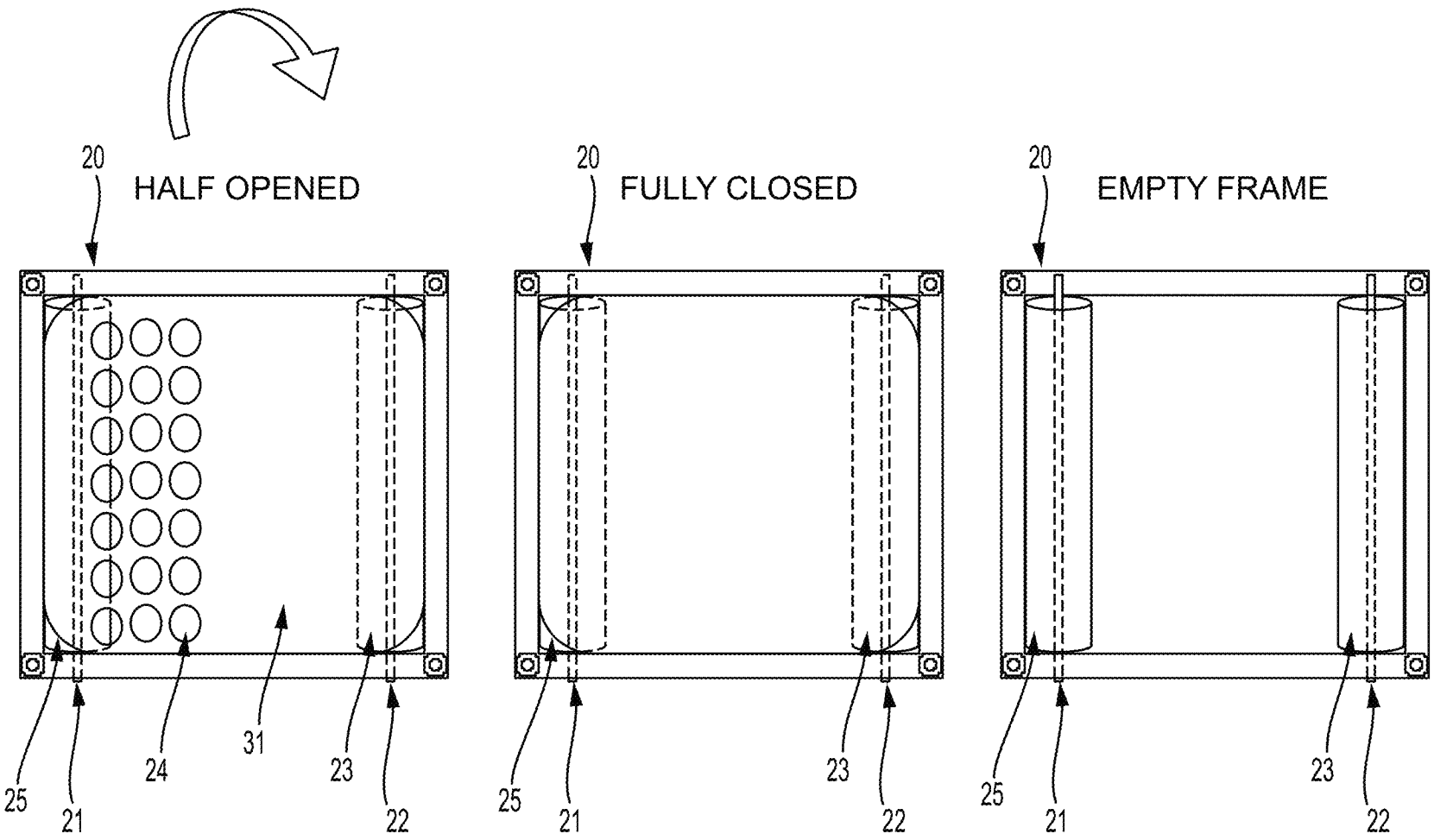
FIG. 3 is a schematic view of the overall structure of the second embodiment of the air duct/vent cover which shows the cover frame and the flexible layer half opened, fully closed, and with just the frame without the flexible layer.

A second embodiment includes a smart air duct/vent cover as shown in FIG. 2. The duct covers a cover frame (20) and a flexible layer (31). The cover frame (110) is formed with an open area as shown in FIG. 3 in the 'empty frame' configuration. The flexible layer (31) disposed on the cover frame (20) covers the open area for forming the air duct/vent. Both ends of the flexible layer are wound around a pair of rotatable rollers (23, 25) which rotate about a pair of respective rods (22, 21). A portion of the flexible layer is perforated by holes (24) such that the air duct/vent flow can pass through the array of holes and enter the ambient air of the occupied room to lower or raise the temperature accordingly. As such, the flexible layer (31) can adapt to the open areas with different sizes by changing the unfolding holed length, so as to form the air outlet wall with different sizes. By arranging the air duct cover plate into the cover plate frame (20) and the flexible layer (31), the air duct cover plate with different sizes can be formed by matching different cover plate frames (20) by utilizing the characteristic that the flexible layer (31) can be rolled or unfolded as shown in FIGS. 2 and 3, which disclose a 'fully opened', 'almost fully opened', 'half opened', 'fully closed', and if no flexible layer is desired, an 'empty frame' configuration. As a result, different-size air duct/vents can be accommodated.

As shown in FIG. 2, the flexible layer (31) may be rolled or unrolled by hand in the length direction using the rollers (21, 23) located at either end of the cover frame (20). This allows for a customization as to the porosity of the flexible layer (31) that a particular room occupant may want while in a particular interior room. The flexible layer (31) can include at least one of a fabric and a nonwoven fabric. The fabric, nonwoven fabric, etc. can have a flexible and foldable property, and can cover the open area to form the air outlet. The thickness of the flexible layer (31) can be adjusted according to practical requirements. In particular, when the flexible layer (31) is a fabric, it may be a double layer fabric, and the fabric material may be a polyester fiber or other high strength material that may be woven. The polyester fiber can be polyether-ether-ketone fiber and/or polytetrafluoroethylene fiber.

When the flexible layer (31) includes at least one of a fabric or non-woven fabric, the flexible layer (31) can have fiber gaps, and the presence of the fiber gaps allows part of cool air to penetrate through the fiber gaps to form an air film on the surface of the flexible layer (31), so that the moist and hot air is prevented from approaching the surface. Condensation is not generated on the flexible layer (31), and the air outlet wall and the air duct cover remain dry and do not easily to grow bacteria.

The flexible layer can also include air supply holes, including through holes (24) provided in the flexible layer (31) and/or a fiber gap of the flexible layer (31). The air supply holes may be formed by forming through holes (24) in the flexible layer (31), and the number and the aperture of the through holes may be adjusted according to actual requirements. When the flexible layer (31) is a fabric or a non-woven fabric, the through holes (24) may be additionally opened after the fabric or non-woven fabric is manufactured, or may be directly manufactured in the fabric or non-woven fabric manufacturing process. The air-sending holes may be formed in the fiber gaps of the flexible layer (31).

When the flexible layer (31) is a fabric or a non-woven fabric, the fiber gaps in the different regions can be adjusted during the manufacturing process to form the air inlet holes as desired. Specifically, the aperture of the air supply hole 131 can be 0.5 to 4 mm, for example, 0.5 mm, 1.3 mm, 2.6 mm, 3.7 mm, 4 mm, or the like. As mentioned above, the flexible layer (31) can include a first rotating roller (25) rotatably disposed by a first rotating rod (21) on the cover frame (20). One end of the flexible layer (31) can be wound around the first rotating roller (25), and the other end of the flexible layer (31) can be wound around a second rotating roller (23) that is also rotatably is disposed on the cover frame (20) by a second rotating rod (22). The first and second rotating rollers (23, 25) can be disposed on respective ends of the cover frame (20) such that the flexible layer is unrolled across the open space of the cover frame.

Figure 5:
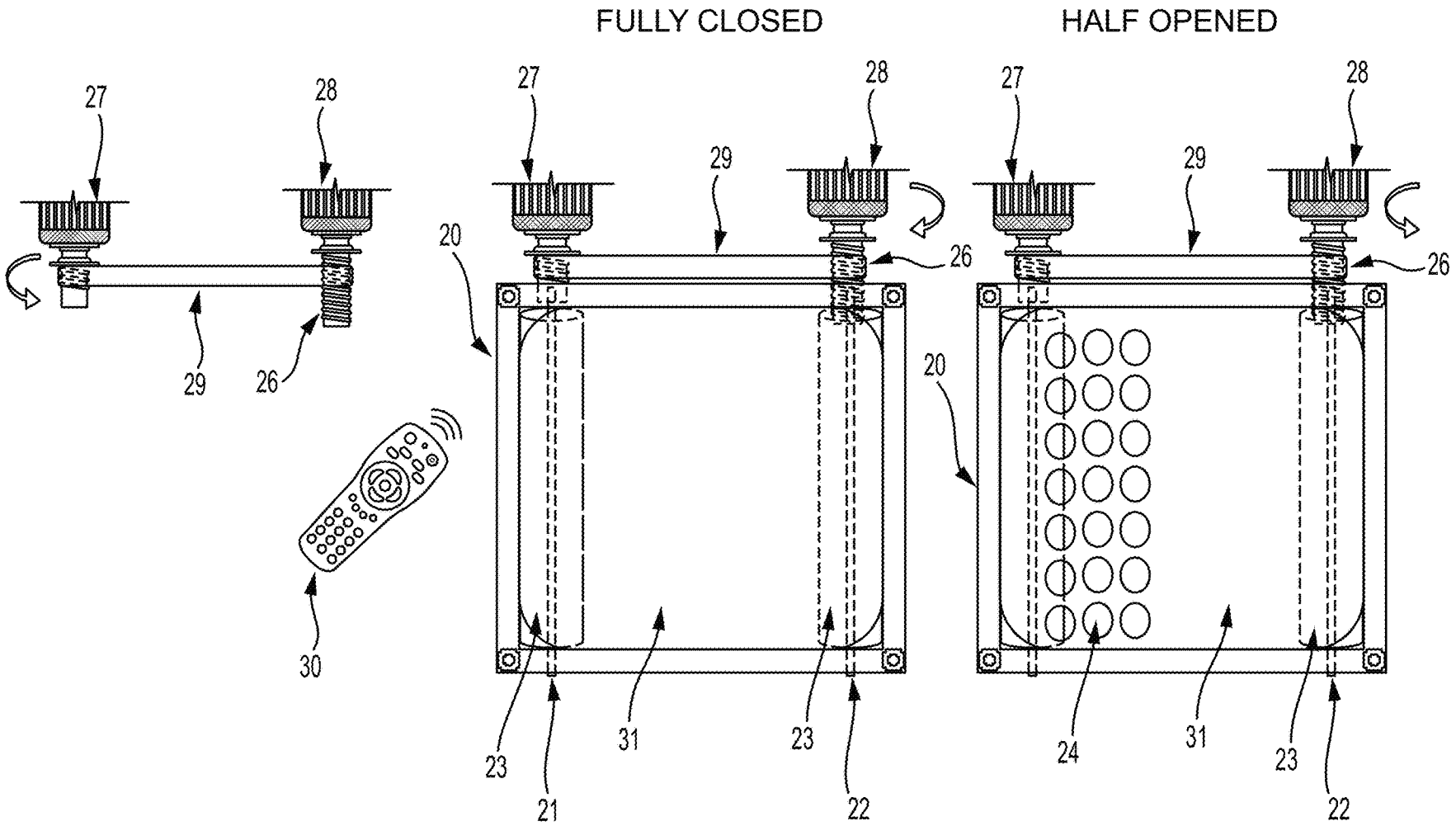
FIG. 5 is a schematic view of the overall structure of the second embodiment of the air duct/vent cover which shows the cover frame and the flexible layer fully closed and half opened along with the modification of a remote controlled motor in cooperation with one of the rotating shafts of the device.

FIG. 5 shows a modification of the first embodiment that includes having motors (27, 28) where one motor (28) drives a threaded screw (26) to engage a rotating rod (22) to provide either a clockwise or counter clockwise rotation to a rotating roller (23) and thereby position the flexible layer (31) into 'fully closed' or 'half opened' configurations as shown in FIG. 5 and the 'fully opened' and 'almost fully opened' configurations of FIG. 2. The motor (28) is attached to one end of a belt drive (29). The other end of the belt drive is attached to a second motor (27) which works in tandem with the commands received by the first motor (28). The first motor (28) is controlled by a handheld remote controller (30) which controls the functionality of the motor (28) of the device using an infrared signal that is transmitted from the handheld controller to the motor of the smart air duct/vent cover.

The threaded screw (26) engages the rotating rod (22) to provide the desired movement to rotating roller (23). A threaded screw also engages a second rotating rod (21)

where this threaded screw is driven the second motor (27). The commands issued by handheld remote controller (12) can unroll or roll up the flexible layer (31) by providing a command to drive the motor (28) to rotate the threaded screw (26) in a clockwise fashion to roll up the flexible layer (31).

In the alternative, the commands issued by handheld remote controller (30) can unfurl the flexible layer (31) by providing a command to drive the motor (28) to rotate the threaded screw (28) in a counterclockwise fashion to position a desired amount of air holes in the open space. The handheld remote (30) can also provide the clockwise and counterclockwise commands for the flexible layer (31) based upon a desired and pre-selected temperature which is measured by the handheld remote. The use of the handheld remote control obviates the need for providing manual force to the smart air duct/vent cover such that the device can now be attached to duct/vent opening that may not be readily accessible by the occupants of the room (i.e., the ceiling or behind furniture).

The components of the second embodiment of the smart air duct/vent cover can be made from plastic, resins, fiberglass, aluminum, other light metals, and/or other suitable materials known in the art and deemed suitable for the implementation of the device.

In the description of the present subject matter, it should be noted that, unless explicitly specified and limited otherwise, the terms "mounted," "connected," and "connected" are to be construed broadly, and may be either fixedly connected, detachably connected, or integrally connected, for example; can be mechanically connected, electrically connected or can be communicated with each other; can be directly connected or indirectly connected through an intermediate medium, and can be communicated with the inside of two elements or the interaction relationship of the two elements. The specific meaning of the above terms in the present subject matter can be understood by those of ordinary skill in the art according to the specific circumstances.

It should be noted that the terms "horizontal", "vertical" and the like do not denote that the component is required to be absolutely horizontal or vertical, but may be slightly inclined; the terms "parallel", "perpendicular" and the like also do not denote absolute parallelism or perpendicularity between the fittings, but may form an angular offset. As "horizontal" merely means that its direction is more horizontal than "vertical", and does not mean that the structure must be perfectly horizontal, but may be slightly inclined. Furthermore, references to orientations or positional relationships of the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise", etc., are based on the orientation or positional relationships shown in the drawings, or are orientation or positional relationships conventionally placed when the product of the present subject matter is used, are merely for convenience in describing embodiments of the present subject matter and to simplify description, and do not indicate or imply that the device or element referred to must have a specific orientation, be configured and operated in a specific orientation, and therefore should not be construed as limiting the present subject matter.

It is to be understood that the device and method for providing air flow is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A smart air/duct vent cover frame, comprising:

a cover frame formed with an open area;

a flexible layer arranged on the cover plate frame, wherein the flexible layer covers the open area and is used for forming an air outlet;

a first rotating roller which is rotatably disposed at a first end of the cover frame by means of a first rotating rod, wherein a first end of the flexible layer is attached to and wound upon on the first rotating roller;

a threaded screw engaging a second end of a second rotating rod;

a second motor coupled to said threaded screw for providing a counter clockwise rotation to a second end of said threaded screw to position the flexible layer into a 'half opened' configuration;

a first motor coupled to said second motor by a belt drive wherein said first motor provides a counter clockwise rotation to said first rotating rod; and a second rotating roller which is rotatably disposed on a second end of the cover frame by means of the second rotating rod, wherein a second end of the flexible layer is attached to and wound upon on the second rotating roller, wherein the flexible layer has through holes provided in the flexible layer and/or fiber gaps of the flexible layer such that air can enter an ambient air space through the through holes provided in the flexible layer.

2. The smart air/duct vent cover frame as recited claim 1, wherein the flexible layer comprises a fabric.

3. The smart air/duct vent cover as recited in claim 1, wherein a handheld remote controller wirelessly transmits infrared signals to the motor.

4. A smart air/duct vent cover frame, comprising:

a cover frame formed with an open area;

a flexible layer arranged on the cover plate frame, wherein the flexible layer covers the open area and is used for forming an air outlet;

a first rotating roller which is rotatably disposed at a first end of the cover frame by means of a first rotating rod, wherein a first end of the flexible layer is attached to and wound upon on the first rotating roller;

a threaded screw engaging a second end of a second rotating rod;

a second motor coupled to said threaded screw for providing a clockwise rotation to a second end of said threaded screw to position the flexible layer into a 'fully closed' configuration; and a first motor coupled to said second motor by a belt drive wherein said first motor provides a clockwise rotation to said first rotating rod; and a second rotating roller which is rotatably disposed on a second end of the cover frame by means of the second rotating rod, wherein a second end of the flexible layer is attached to and wound upon on the second rotating roller, wherein the flexible layer has through holes provided in the flexible layer and/or fiber gaps of the flexible layer such that air can enter an ambient air space through the through holes provided in the flexible layer.

* * * * *